US005119527A

United States Patent [19]

Röck

[11] Patent Number: 5,119,527

[45] Date of Patent: Jun. 9, 1992

[54] HINGE WITH IMPROVED SNAP ENGAGEMENT LOCKING AND UNLOCKING STRUCTURE

[75] Inventor: Erich Röck, Höchst, Austria

[73] Assignee: Julius Blum Gesellschaft m.b.H., Höchst, Austria

[21] Appl. No.: 696,627

[22] Filed: May 7, 1991

[30] Foreign Application Priority Data

May 16, 1990 [AT] Austria ..... 1085/90

[51] Int. Cl.[5] ..... E05D 7/10

[52] U.S. Cl. ..... 16/258; 16/238

[58] Field of Search ..... 16/238, 237, 236, 258, 16/DIG. 43

[56] References Cited

U.S. PATENT DOCUMENTS 4,423,537 1/1984 Salice ..... 16/258

4,654,932 4/1987 Rock et al. ..... 16/258

5,025,530 6/1991 Ferrari et al. ..... 16/258

*Primary Examiner*—Robert L. Spruill

*Assistant Examiner*—Carmine Cuda

*Attorney, Agent, or Firm*—Wenderoth, Lind & Ponack

[57] ABSTRACT

A hinge includes a hinge arm which is mounted on a base plate so as to be adjustable. The hinge arm is mounted on an intermediate member or component by a gap adjusting screw and a clamping screw. The hinge arm can be locked on the base plate by means of a resilient snap engagement mechanism and at two bearing points, offset along the length of the hinge arm, is mounted indirectly on the base plate via the intermediate component. Separate, spring-loaded locking members or components are provided at the two bearing points. A manually operable unlocking device provides simultaneous unlocking of the locking members.

29 Claims, 7 Drawing Sheets

HINGE WITH IMPROVED SNAP ENGAGEMENT LOCKING AND UNLOCKING STRUCTURE

BACKGROUND OF THE INVENTION

The invention relates to a hinge comprising a hinge arm which is mounted on a base plate so as to be adjustable, with a gap adjusting screw or the like and with an adjusting device which operates in the direction of the depth of an article of furniture. The hinge arm can be locked on the base plate by means of a resilient, snap engagement mechanism and at two bearing points offset along the length of the hinge arm is mounted indirectly on the base plate via an intermediate component of U-shaped cross-section. A manually operable unlocking device enables the locking components to be simultaneously unlocked.

A hinge of this type is disclosed, for example, in Austrian AT-PS 384 270. Such hinge has a swiveling member bearing a locking hook and rotatably mounted on a metallic intermediate component. A spring presses the swiveling member with its locking hook into a locking position. The swiveling member is provided with a grip which allows the intermediate component to be released from the base plate. For assembly, the intermediate component is suspended by its front end, i.e. the end closest to the axis of rotation of the hinge, in a groove-like recess of the base plate and is pivoted about the thus formed pivot bearing until the hook of the swiveling member engages into the base plate at the rear end thereof. The intermediate component is connected to the hinge arm by means of a gap adjusting screw and a depth adjusting screw. In comparison to earlier hinges, such hinge has the advantage that no tool is required for the actual assembly of furniture doors to a body of the article of furniture. In order to fix the hinge arm on the base plate it is sufficient for the hinge arm, together with the intermediate component, to be suspended on the base plate and pressed onto the base plate.

SUMMARY OF THE INVENTION

The object of the present invention is to improve upon a hinge of this type such that the mounting or suspending of the hinge is simplified, i.e. the assembly possibilities are extended. The invention provides that it is possible for the hinge arm, with the intermediate component to be suspended from the base plate at the front end and pivoted about a thus formed pivot bearing, or for the hinge arm, with the intermediate component, to be suspended from the base plate at the rear end and pivoted about a thus formed pivot bearing, or for the hinge arm and the intermediate component to be pressed on, so to speak, parallel to the base plate.

The above object of the invention is fulfilled in that individual spring-loaded locking components, which are separate from the unlocking device, are provided at the two bearing points. To facilitate the pressing on of the hinge arm, advantageously it is provided that the locking components move in opposite directions.

In an exemplary embodiment of the invention it is provided that the locking components are elastic and are formed by two double-armed levers, where one lever arm is supported on the intermediate component and where in each case one of the lever arms of each double-armed lever has an opening through which extends a projection of the base plate.

An advantageous embodiment of the invention provides that the unlocking device comprises a rocker arm which abuts against a locking component and onto which is suspended a push rod or the like, by means of which a locking component can be moved from a locking position. The push rod can be provided with a projection by which it is suspended in an opening of one of the double-armed levers. On the other hand the push rod can be provided at its free end with a slot which accommodates one of the locking components.

In a further exemplary embodiment, the locking components are formed by pins which are received by slots in lateral members of the intermediate component and which are commonly acted upon by a spring. Here it is essential that the spring acts on both of the locking components. Naturally a plurality of springs can be provided in order to amplify the spring effect. To facilitate the mounting of the components it is provided that the spring embraces the locking components in the manner of a clamp.

In order to facilitate the centering or precise positioning of the intermediate component with the hinge arm, advantageously it is provided that the lateral members of the intermediate component have projections which are received in slots of the base plate, or that the base plate is provided with wedge-shaped shoulders which, in the mounted position, project into wedge-shaped recesses of the lateral members of the intermediate component.

In a further exemplary embodiment of the invention, there are provided two push rods which are aligned in the longitudinal direction of the hinge arm and by which the locking components can be pressed out of their engaged position in the base plate. The push rods can be displaced by means of two slides which have wedge-shaped surfaces and extend transversely to the longitudinal axis of the hinge arm. The slides are provided with push-button-like projections which extend through lateral members of the hinge arm. In this way, when the hinge arm is dismounted, it is easily possible to release locking by means of the push-button-like projections and at the same time to grip the hinge arm and remove it from the base plate.

BRIEF DESCRIPTION OF THE DRAWINGS

In the following, exemplary embodiments of the invention will be described in detail, with reference to the accompanying drawings, wherein:.

DETAILED DESCRIPTION OF THE INVENTION

Figure 1:
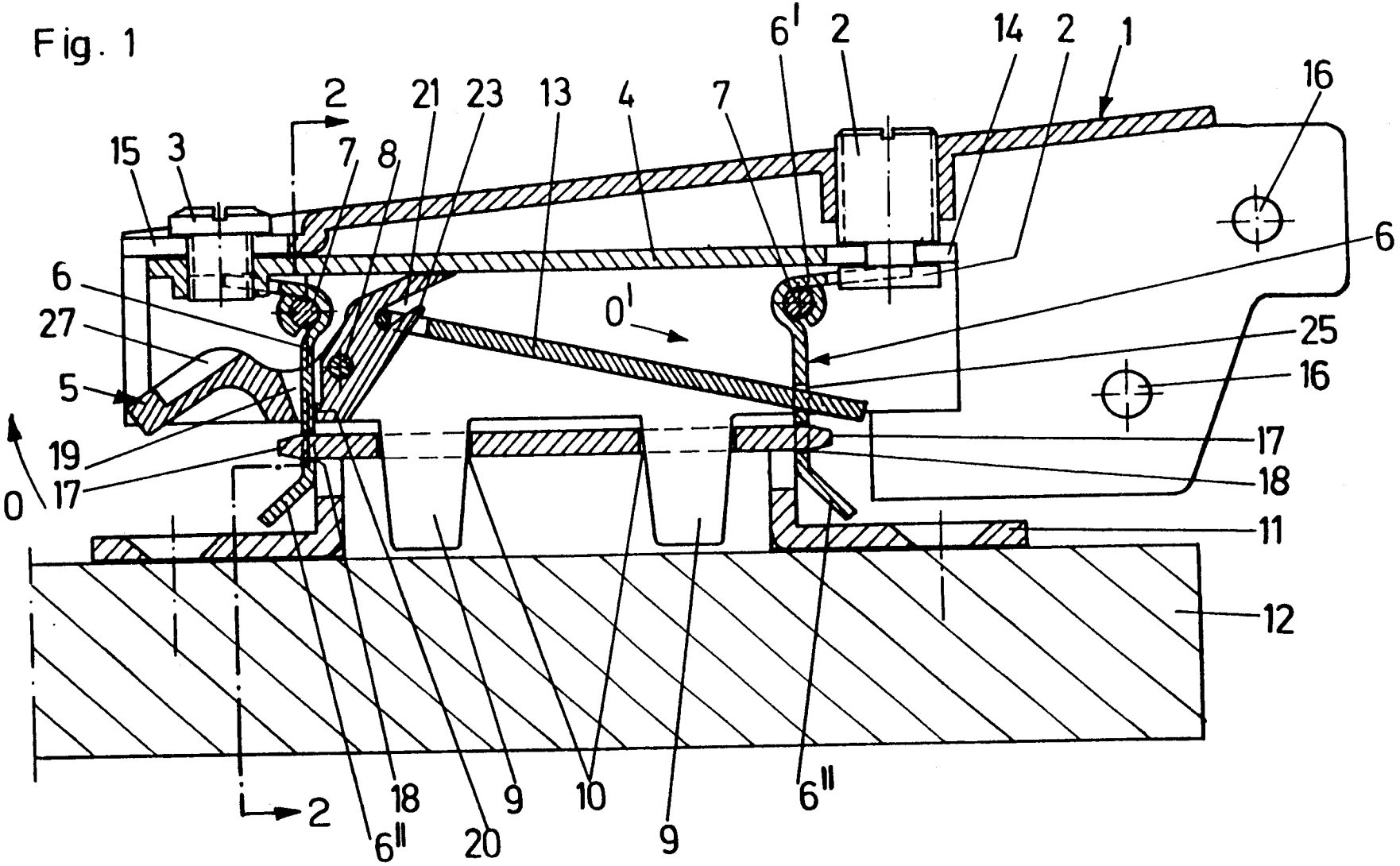
FIG. 1 is a longitudinal section through a hinge arm mounted on a base plate by means of an intermediate component.
Figure 2:
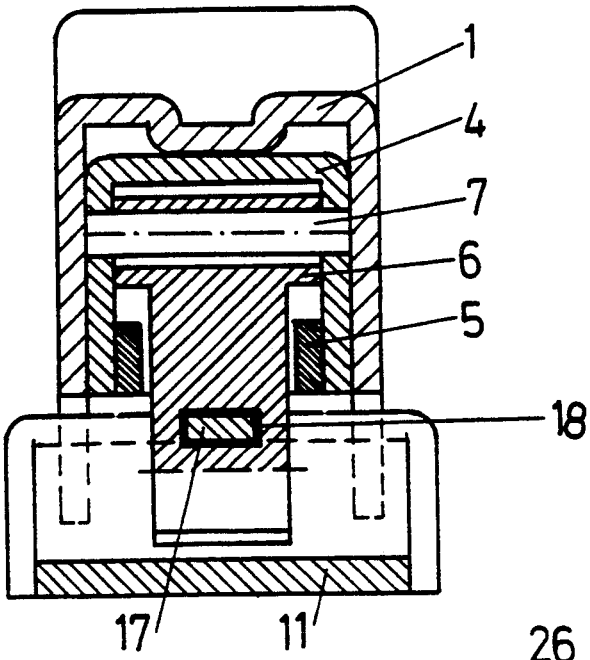
FIG. 2 is a section along line 2—2 of FIG. 1.
Figure 3:
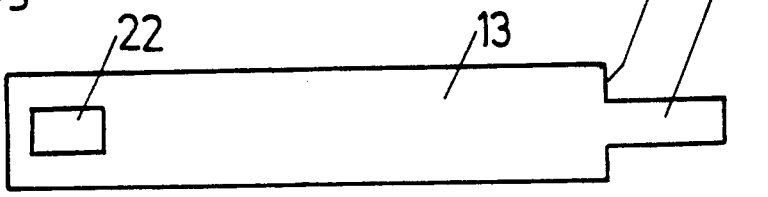
FIG. 3 is a plan view of a push rod.

Those parts of the hinge which do not relate to the invention, such as a hinge cup which is to be inserted into a door leaf, and an articulated lever which connects the hinge cup to a hinge arm, have not been illustrated in the drawings, and are designed in accordance with the known prior art. The hinge can also be provided with a conventional closing mechanism.

The main parts of the hinge of the invention comprise a hinge arm 1, an intermediate member or component 4 and a base plate 11.

The base plate 11 is attached in a conventional fashion to a side wall 12 of an article of furniture by means of screws or dowels. The hinge arm 1 is mounted on the intermediate component 4 by means of a gap adjusting screw 2 and a clamping screw 3 which also enables depth adjustment. A head 2' of the gap adjusting screw 2 projects through a frontwardly open slot 14 in the intermediate component 4, and the clamping screw 3 projects through a rearwardly open slot 15 in the hinge arm 1. By rotating the gap adjusting screw 2, it is possible to adjust the positions of axes 16 of hinge pins with respect to a gap of a door of the article of furniture. If the clamping screw 3 is released, the hinge arm 1 can be adjusted in the direction of the depth of the article of furniture along the length of the slot 15 (the slot 14 is preferably of equal length).

The base plate 11 is made of sheet steel and at the front and rear thereof includes respective projections 17. Double-armed levers 6 which form locking components are mounted on the intermediate component 4 on respective pivot pins 7. Each double-armed lever is supported by an arm 6' thereof on a central member of the intermediate component 4. The other arm 6'' of each double-armed lever 6 has an opening 18 through which extends a respective projection 17 of the base plate 11 when in the mounted position. The double-armed levers 6 are designed to be flexible, for example are composed of sheet steel, and thus arms 6'' constantly are pressed toward the projections 17 and the base plate 11.

The intermediate component 4 is U-shaped in cross-section and is provided on each of two lateral or side members or portions thereof with two projections 9 which extend through respective slots 10 in the base plate 11. In this way the intermediate component 4 is positioned on the base plate 11 without play.

A rocker arm 5 is mounted on a pivot pin 8 inside the U-shaped profile of the intermediate component 4. The rocker arm 5 has a funnel-shaped opening 19 through which projects arm 6'' of a rear one of the double-armed levers 6. The rocker arm 5 is provided with a stop surface 20 which abuts against such arm 6'' when the intermediate component is released. The rocker arm 5 has a slot 21 in which is suspended a push rod 13. The push rod has an opening 22 through which extends a projection 23 which delimits the slot 21. Push rod 13 also has a projection 24 which is suspended in an opening 25 in the arm 6'' of a front double-armed lever 6. The push rod 13 is supported on this arm 6'' by means of a shoulder 26 of the push rod.

The rocker arm 5 is provided with a grip member 27 which is accessible at the rear end of the hinge arm 1. If the rocker arm 5 is rotated by means of the grip member 27 in the direction of an arrow 0, on the one hand the stop surface 20 abuts against the arm 6'' of the rear double-armed lever 6 to push it away from the respective projection 17, and on the other hand the push rod 13 is moved in the direction of an arrow 0' whereby the arm 6'' of the front double-armed lever is pushed away from the base plate 11 and from the respective projection 17. The hinge arm 1 now can be raised, with the intermediate component 4, from the base plate 11.

Figure 5:
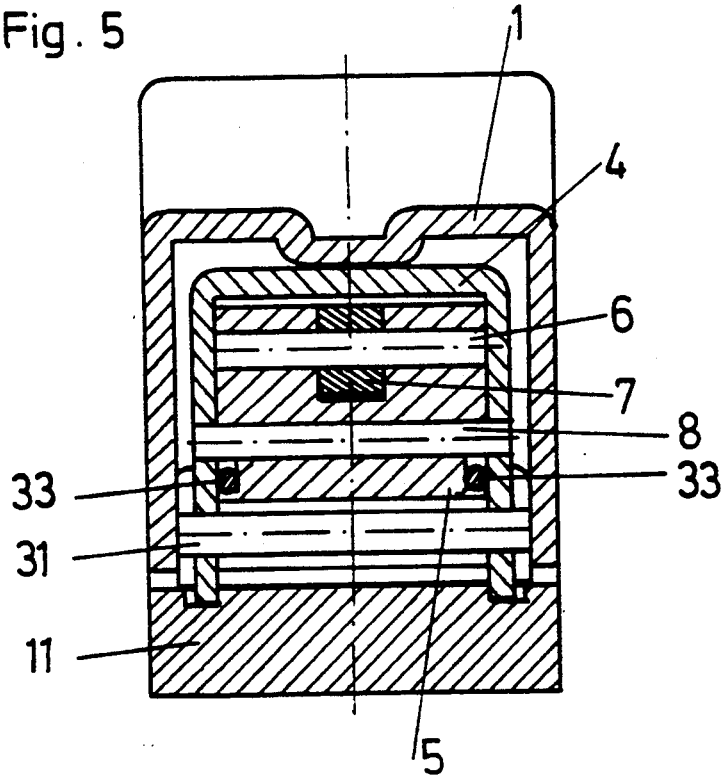
FIG. 5 is a section along line 5—5 of FIG. 4.
Figure 4:
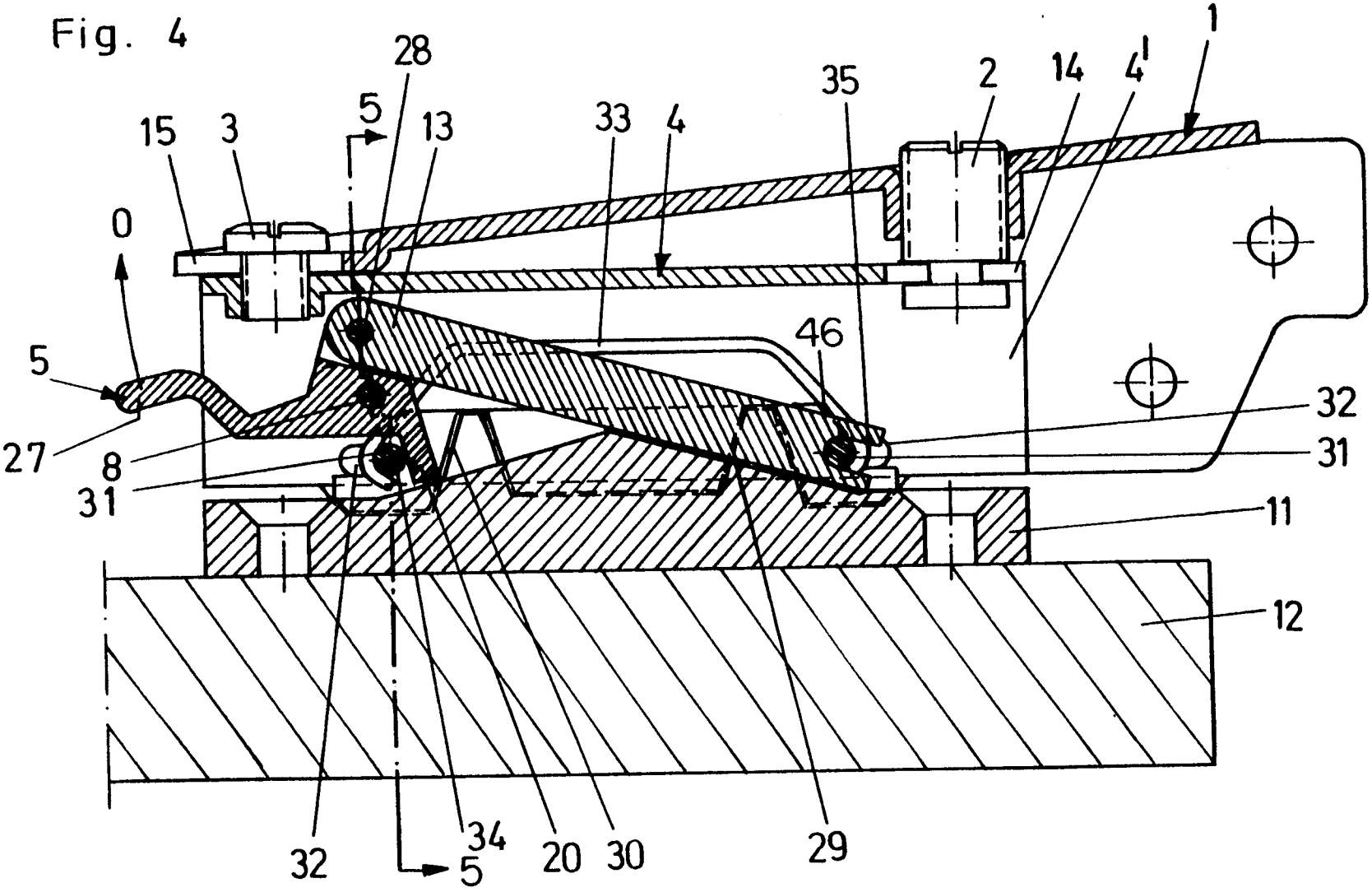
FIG. 4 is a longitudinal section through a hinge arm mounted on a base plate in accordance with a further exemplary embodiment of the invention.
Figure 6:
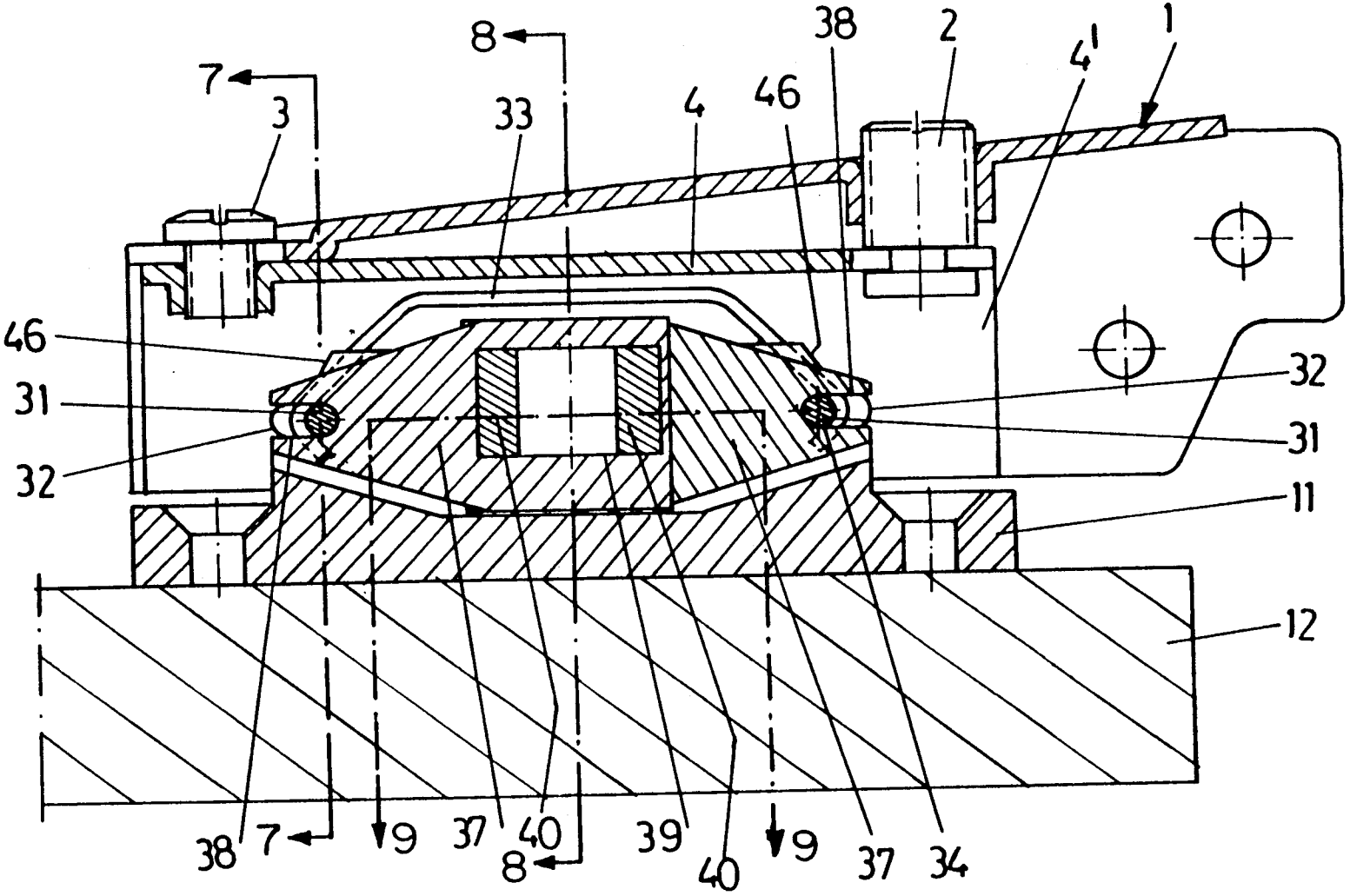
FIG. 6 is a longitudinal section through a hinge arm mounted on a base plate in accordance with a further exemplary embodiment of the invention.
Figure 7:
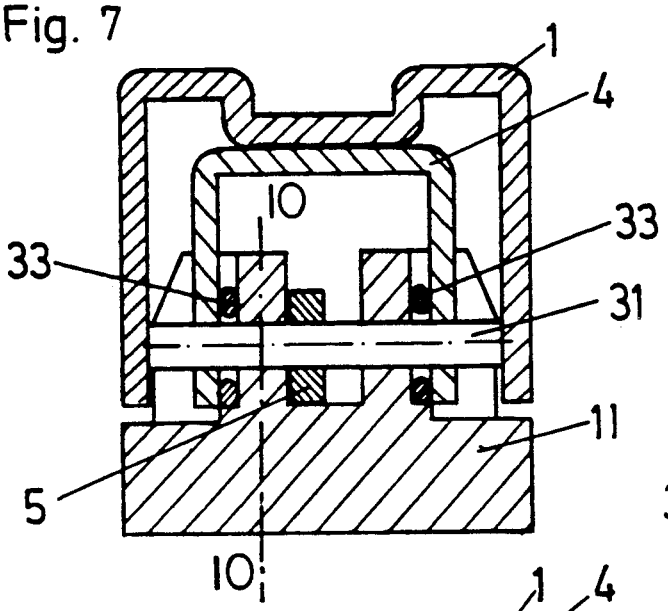
FIG. 7 is a section along line 7—7 of FIG. 6.
Figure 8:
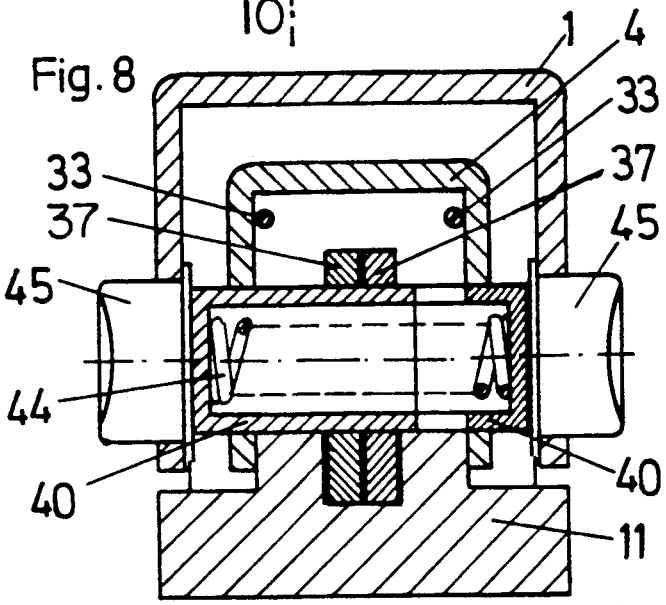
FIG. 8 is a section along line 8—8 of FIG. 6.
Figure 10:
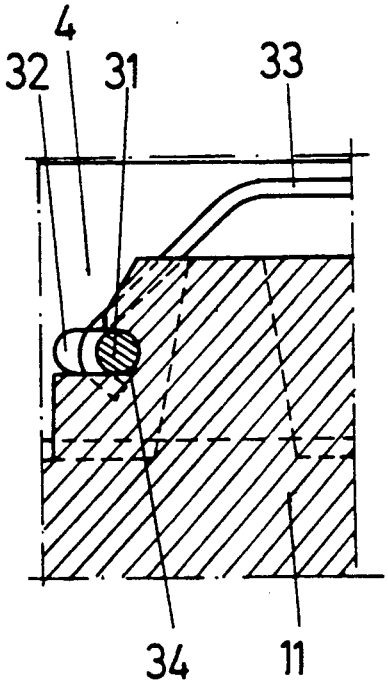
FIG. 10 is a section along line 10—10 of FIG. 7.
Figure 9:
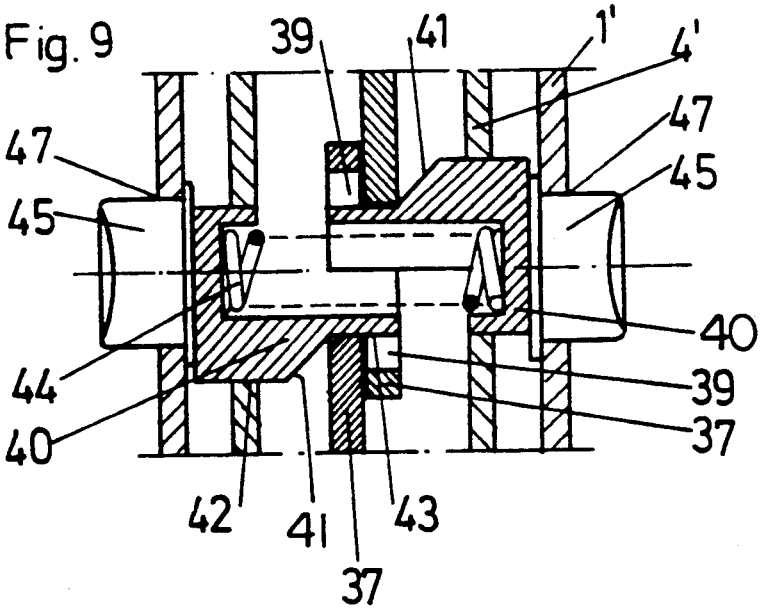
FIG. 9 is a section along line 9—9 of FIG. 6.
Figure 11:
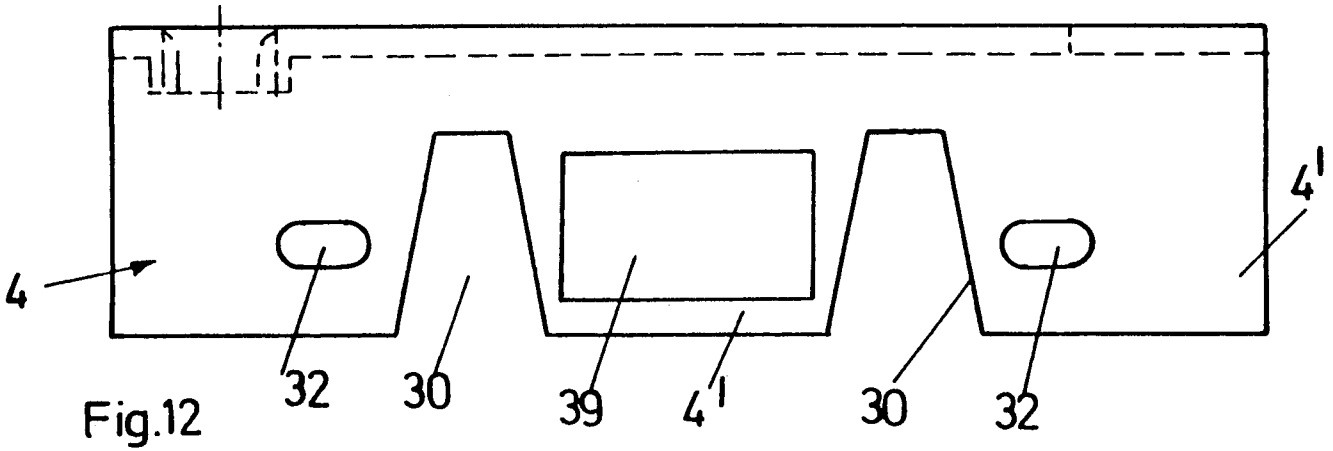
FIG. 11 is a side view of an intermediate component.
Figure 12:
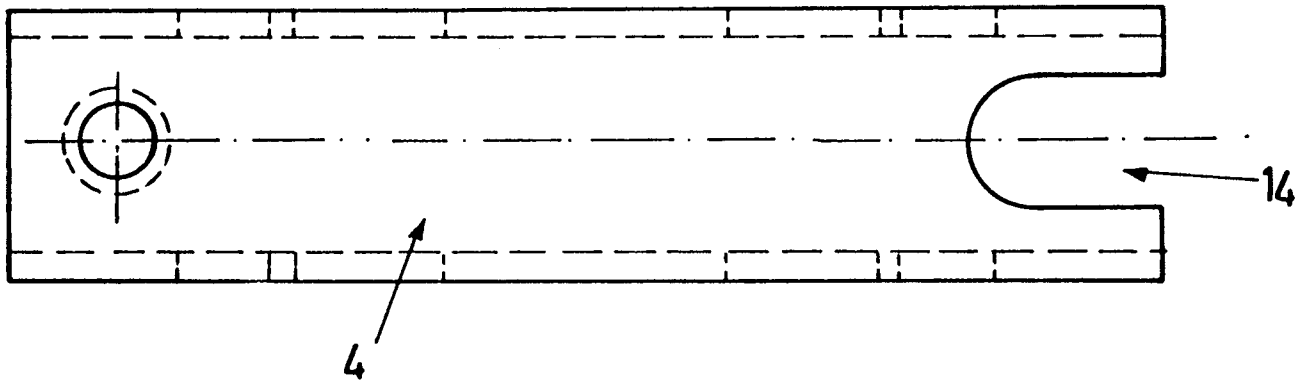
FIG. 12 is a plan view of the intermediate component.
Figure 13:
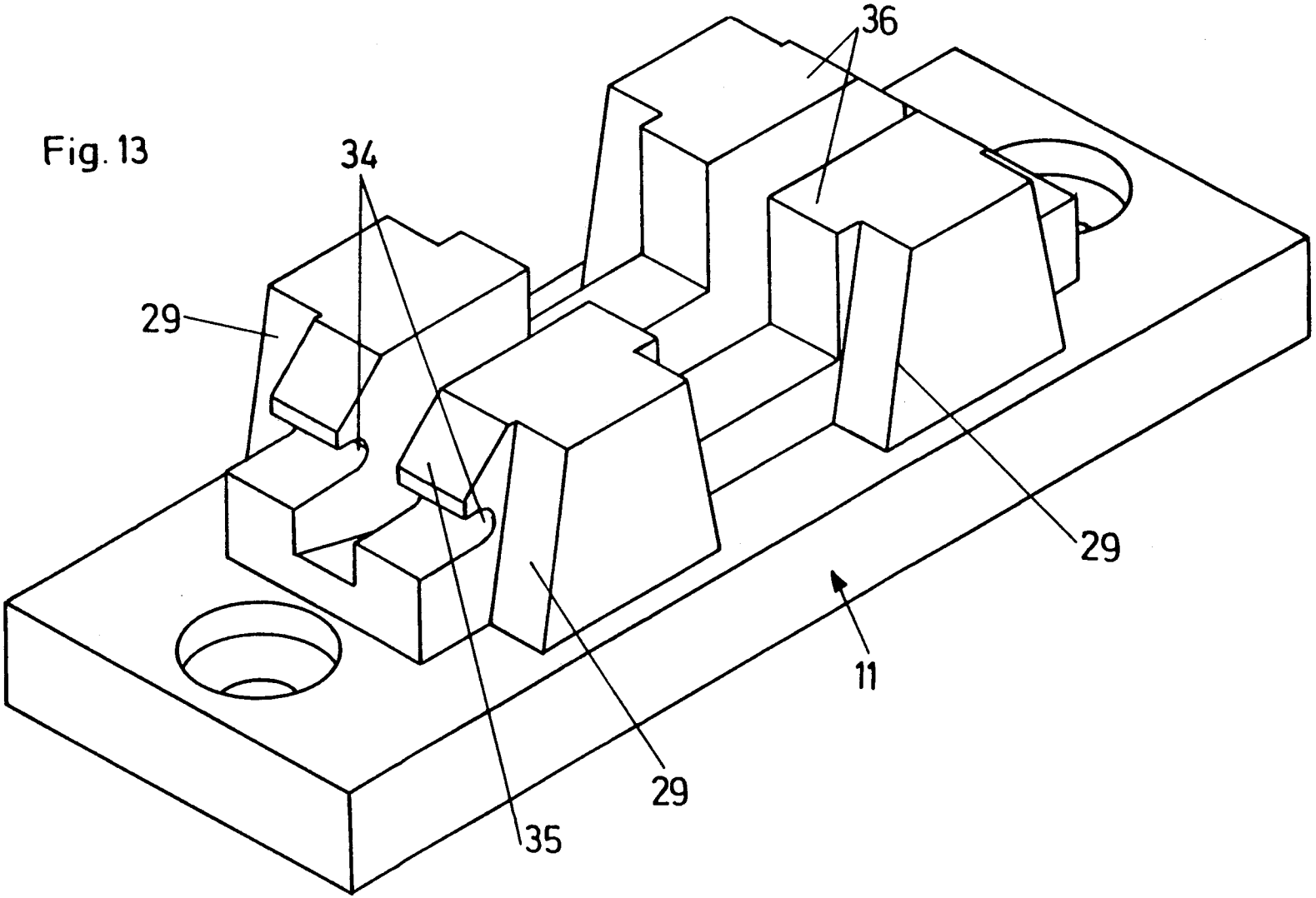
FIG. 13 is a perspective view of a base plate.

In the exemplary embodiment illustrated in FIGS. 4 and 5, the hinge arm 1, in the same manner as in the preceding exemplary embodiment, is mounted on the intermediate component 4 by means of a gap adjusting screw 2 and a clamping screw 3. Also, a rocker arm 5 in which is suspended a push rod 134 is rotatably mounted in the intermediate component 4. In this embodiment however, the push rod 13 is not suspended in an open slot 21 of the rocker arm, but is connected to the rocker arm by means of a pivot pin 28. Also in this embodiment, the centering of the intermediate component 4 on the base plate 11 takes place in a manner reverse to the previous embodiment. That is, the base plate 11 is provided with wedge-shaped projections 29 which project into corresponding recesses 30 in the lateral members 4'' of the intermediate component 4.

The locking components in this embodiment are formed by pins 31 which are received in slots 32 in the lateral members 4' of the intermediate component 4. The pins 31 are embraced by a spring 33 in the manner of a clamp. If the hinge arm, with the intermediate component 4, is pressed onto the base plate 11, the pins 31 engage in grooves 34 of the base plate 11. The pressing on of the pins 31 is facilitated by sloping surfaces 46 on the base plate 11.

In the illustrated arrangement two springs 33 are provided. When the hinge arm 1 is mounted, the springs 33 continuously press the pins 31 into the engaged position. To release the intermediate component 4, the rocker arm 5 is rotated by means of the grip member 27 in the direction of the arrow 0. The stop surface 20 presses the rear pin 31 out of the respective groove 34 in the base plate 11, and the front pin 31 is also pressed out of the front groove 34 of the base plate 11 by means of the push rod 13. The front pin 31 is received in a frontwardly open slot 35 of the push rod 13. When the rocker arm 5 is rotated, the locking of the intermediate component 4 is released simultaneously at both the front and the rear positions. The pins 31 are pushed frontwards and rearwards away from the base plate 11. The hinge arm 1 together with the intermediate component 4 then can be removed from the base plate 11.

In the exemplary embodiment illustrated in FIGS. 6 to 10, the hinge arm 1, as in the two previously described exemplary embodiments, is again mounted on the intermediate component 4 by means of the gap adjusting screw 2 and the clamping screw 3. The locking elements are again formed by pins 31 which engage in grooves 34 of the base plate 11 and which are received in slots 32 in the lateral members 4' of the intermediate component 4.

The mounting of the hinge arm 1, with the intermediate component 4, takes place as in the previously described exemplary embodiment, i.e. the hinge arm 1, with the intermediate component 4, is pressed onto the base plate 11 so that the pins 31 engage in the grooves 34. Here it is immaterial whether both pins 31 engage simultaneously or whether the front or the rear pin engages first in the corresponding groove 34 of the base plate 11.

Push rods 37 are arranged in the intermediate component 4. The push rods 37 have grooves 38 in which are received the pins 31. Furthermore, each push rod 37 is provided with an opening or window 39 Slides 40 having wedge-shaped surfaces 41 project through the windows 39 of the two push rods 37. The slides 40 are received in apertures 42 which are formed in the lateral members 4' of the intermediate component. For improved guidance, the slides 40 are provided with shoulders 43 which project through the windows 39 when the hinge arm is in the mounted position.

A helical spring 44 urges the slides 40 away from one another and against lateral members 1' of the hinge arm 1. The slides 40 have push-button-like projections 45 which extend through apertures 47 in the lateral members 1' of the hinge arm 1.

In order to release the hinge arm 1 and the intermediate component 4 from the base plate 11, the slides 40 can be compressed by means of the push-button-like projections 45, whereby the wedge-shaped surfaces 41 each abut against the edge of a corresponding window 39. As a result, the push rods 37 are moved longitudinally apart, i.e. towards the front and rear ends of the hinge arm 1. The pins 31 are thus forced out of the grooves 34 in the base plate 11, and the intermediate component 4 and the hinge arm 1 are free.

A particular advantage of this embodiment is that when the slides 40 are compressed, the hinge arm 1 is simultaneously laterally embraced and thus easily can be removed from the base plate 11.

I claim:

1. A hinge for use in an article of furniture, said hinge comprising:

a base plate to be mounted on a body of the article of furniture;

an elongate hinge arm to be connected to a furniture door;

an intermediate member having a U-shaped cross section and adjustably connected to said hinge arm;

resilient snap engagement means for lockingly mounting said intermediate member, and thereby said hinge arm, to said base plate at two bearing points spaced from each other in a longitudinal direction of said hinge arm, said resilient snap engagement means comprising two spring-loaded locking members positioned at respective said bearing points; and manually operable unlocking means, separate from said locking members, for simultaneously unlocking said locking members.

2. A hinge as claimed in claim 1, wherein each said locking member is movable in opposite directions.

3. A hinge as claimed in claim 1, wherein said locking members are movable in opposite directions to respective locking positions thereof.

4. A hinge as claimed in claim 1, wherein each said locking member comprises an elastic double-armed lever including a first arm supported on said intermediate member.

5. A hinge as claimed in claim 4, wherein each said double-armed lever further includes a second arm engaging said base plate at a respective said bearing point.

6. A hinge as claimed in claim 5, wherein each said second arm has therethrough an opening through which extends a respective projection of said base plate.

7. A hinge as claimed in claim 5, wherein said unlocking means comprises a rocker arm mounted in abutment with a first said double-armed lever, whereby movement of said rocker arm in a direction against the elastic force of said first double-armed lever moves said first double-armed lever out of a locking position thereof.

8. A hinge as claimed in claim 7, wherein said unlocking means further comprises a push rod operably associated with said rocker arm and a second said double-armed lever such that, as said rocker arm is moved in said direction, said push rod moves said second double-armed lever in a direction against the elastic force thereof and out of a locked position thereof.

9. A hinge as claimed in claim 8, wherein said push rod has at a first end thereof an opening receiving a projection of said rocker arm, and said push rod has at a second end thereof a projection extending into an opening in said second double-armed lever.

10. A hinge as claimed in claim 9, wherein said opening in said second double-armed lever is in said second arm thereof, and said projection at said second end of said push rod defines a shoulder in abutment with said second arm of said second double-armed lever.

11. A hinge as claimed in claim 9, wherein said projection of said rocker arm is defined by an open-ended slot in said rocker arm.

12. A hinge as claimed in claim 7, wherein said rocker arm has therethrough an opening through which projects said second arm of said first double-armed lever.

13. A hinge as claimed in claim 12, wherein said opening is funnel-shaped.

14. A hinge as claimed in claim 1, wherein said unlocking means comprises a rocker arm mounted in abutment with a first said locking member, whereby movement of said rocker arm in a direction against the spring force of said first locking member moves said first locking member out of a locking position thereof.

15. A hinge as claimed in claim 14, wherein said unlocking means further comprises a push rod operably associated with said rocker arm and a second said locking member such that, as said rocker arm is moved in said direction, said push rod moves said second locking member in a direction against the spring force thereof and out of a locked position thereof.

16. A hinge as claimed in claim 1, wherein said U-shaped intermediate member has spaced side portions having projections received in respective slots in said base plate, thereby positioning said intermediate member relative to said base plate.

17. A hinge as claimed in claim 16, wherein said projections are wedge-shaped.

18. A hinge as claimed in claim 1, wherein each said locking member comprises a pin received in respective slots formed in spaced side portions of said U-shaped intermediate member.

19. A hinge as claimed in claim 18, wherein said pins of both said locking members are acted on simultaneously by a spring.

20. A hinge as claimed in claim 19, wherein said spring embraces said pins in the manner of a clamp.

21. A hinge as claimed in claim 19, comprising two said springs simultaneously acting on both said pins.

22. A hinge as claimed in claim 18, wherein said base plate has extending therefrom wedge-shaped projections fitting into wedge-shaped recesses in said side portions of said intermediate member.

23. A hinge as claimed in claim 1, wherein said unlocking means comprises a pair of push rods aligned in the longitudinal direction of said hinge arm and operable to move respective of said locking members out of locking positions thereof.

24. A hinge as claimed in claim 23, further comprising slide members extending transversely of said longitudinal direction and having wedge-shaped surfaces acting on said push rods such that, as said slide members are moved in first directions, said push rods are operated to move said locking members out of said locking positions thereof.

25. A hinge as claimed in claim 23, wherein said push rods have therein openings through which extend said slide members.

26. A hinge as claimed in claim 25, wherein said slide members have projections extending through respective side portions of said hinge arm.

27. A hinge as claimed in claim 26, wherein said projections are configured as push buttons.

28. A hinge as claimed in claim 23, wherein said slide members extend through apertures in respective side portions of said U-shaped intermediate member.

29. A hinge as claimed in claim 23, further comprising a spring urging said slide members in second directions opposite to said first directions.

* * * * *

UNITED STATES PATENT AND TRADEMARK OFFICE

CERTIFICATE OF CORRECTION

PATENT NO. : 5,119,527

DATED : June 9, 1992

INVENTOR(S) : ERICH RÖCK

It is certified that error appears in the above-identified patent and that said Letters Patent is hereby corrected as shown below:

Column 7, claim 25, line 1, change "23" to --24--.

Column 8, claim 28, line 1, change "23" to --24--.

Column 8, claim 29, line 1, change "23" to --24--.

Signed and Sealed this

Twenty-third Day of June, 1998

Bruce Lehman

*Attest:*

BRUCE LEHMAN

*Attesting Officer*

*Commissioner of Patents and Trademarks*